United States Patent [19]

Fournier

[11] Patent Number: 4,963,057

[45] Date of Patent: Oct. 16, 1990

[54] SLUICE GATE FOR AUTOMATICALLY REGULATING A LEVEL

[75] Inventor: Thierry Fournier, Andilly, France

[73] Assignee: Societe Anonyme dite: Alsthom Fluides, La Courneuve, France

[21] Appl. No.: 459,897

[22] Filed: Jan. 2, 1990

[30] Foreign Application Priority Data

Jan. 3, 1989 [FR] France ..... 8900028

[51] Int. Cl.[5] ..... E02B 7/20; E02B 7/50

[52] U.S. Cl. ..... 405/93; 405/92; 405/100

[58] Field of Search ..... 405/84, 85, 86, 87, 405/92, 93, 94, 96, 97, 100

[56] References Cited

U.S. PATENT DOCUMENTS

| | | | |
|---|---|---|---|
| 2,207,479 | 7/1940 | Danel | 405/94 |
| 2,645,089 | 7/1953 | Ponsar | 405/96 |
| 2,699,652 | 1/1955 | Laszlo | 405/97 |
| 3,066,490 | 12/1962 | Dubouchet | 405/96 |
| 3,221,504 | 12/1965 | Turner | 405/93 |
| 3,643,443 | 2/1972 | Alexandre | 405/97 |
| 3,693,355 | 9/1972 | Dubouchet | 405/100 X |
| 3,739,585 | 6/1973 | Dubouchet | 405/97 |
| 3,753,353 | 8/1973 | Dubouchet | 405/87 |
| 4,027,487 | 6/1977 | Alexandre | 405/97 |
| 4,449,851 | 5/1984 | Combes et al. | 405/100 X |
| 4,606,672 | 8/1986 | LeSire | 405/87 |
| 4,797,027 | 1/1989 | Combes et al. | 405/87 X |

FOREIGN PATENT DOCUMENTS

| | | |
|---|---|---|
| 0083800 | 7/1983 | European Pat. Off. . |
| 0249558 | 12/1987 | European Pat. Off. . |
| 2071299 | 9/1971 | France . |
| 2289828 | 5/1976 | France . |

*Primary Examiner*—Dennis L. Taylor
*Assistant Examiner*—J. Russell McBee
*Attorney, Agent, or Firm*—Sughrue, Mion, Zinn, Macpeak & Seas

[57] ABSTRACT

The gate of the present invention regulates the level of a downstream reach (4) by means of a sector-shaped plate (1) carried by a frame (6, 7) that oscillates about a axis (5) and that also carries a float (8) dipping into said reach. Substantially neutral equilibrium is obtained at a reference level by raising the center of gravity above the oscillation axis, and the reference level is adjusted by transferring water between two longitudinally offset tanks (11, 13). The invention is particularly suitable for irrigation networks.

8 Claims, 5 Drawing Sheets

SLUICE GATE FOR AUTOMATICALLY REGULATING A LEVEL

The present invention relates to regulating a water level by means of an automatic sluice gate. Such a gate is disposed for this purpose between an upstream reach and a downstream reach, with the term "reach" being used herein to designate not only a canal reach per se, but also any basin containing a body of water with a free surface. The present invention relates more particularly to such a gate whose function is to keep the level of one of the reaches as constant as possible, which reach is referred to below as the "level-regulated reach".

BACKGROUND OF THE INVENTION

One such prior art gate comprises various essential items in common with a gate of the present invention for the case where the level-regulated reach is the downstream reach. These essential items in common are initially described in order to specify the technical context in which the present invention is situated. The comprise:

a channel along which the upstream and downstream reaches follow one another in a longitudinal horizontal direction;

a horizontal oscillation axis disposed transversely across the downstream end of the channel; and an oscillating assembly, said assembly moving about said axis between angular positions extending between a closed position and an open position, with each position being defined by an opening angle relative to said closed position, said assembly itself comprising:

a frame having an upstream branch and a downstream branch respectively upstream and downstream from said axis;

a plate carried by said upstream branch and disposed in said channel to close it to a greater or lesser extent, thereby controlling the water flow rate through the gate, said channel being closed in said closed position and open in said open position, said plate being cylindrical in shape about said axis to ensure that the hydrostatic thrust it receives from the upstream reach does not apply any interfering couple to said oscillating assembly;

a float carried by said downstream branch so as to dip a variable portion of its height into the water of said downstream reach in order to apply a float couple directed towards said closed position and increasing firstly with an increase in said downstream level and secondly with an increase in said opening angle, said float being substantially in the form of a body of revolution about said axis and occupying a limited angular sector in such a manner that said float couple varies substantially linearly with said angle; and balancing masses situated at least in part at a longitudinal distance from said axis in order to apply a gravity couple to said oscillating assembly and directed towards said open position.

The purpose of these masses is to achieve balance in the assembly when the level of the downstream reach is at a reference level. The masses are situated at least in part at a vertical distance above said axis so that said balance is a substantially neutral balance which occurs at least approximately in all of said angular positions. The substantially neutral nature of this balance has the major advantage that any difference between the downstream level and the reference level imposes a sufficiently large angular displacement on the oscillating assembly to eliminate said difference in level quickly and almost completely.

Such gates are described in French Pat. Nos. 2 071 299 and 2 076 249, and in corresponding U.S. Pat. Nos. 3,683,630 and 3,643,443.

More particularly, the float of such a prior gate is fixed at the downstream end of the frame. Part of it dips into a tank which communicates with the downstream reach via a slot formed in the bottom thereof. A first gate balancing mass is inserted into the float via a hatch situated in the top thereof. A second balancing mass is inserted into a bin fixed on the frame at a point situated substantially vertically above the oscillation axis when the gate is in its closed position. These masses are chosen in such a manner as to ensure that the gate is balanced regardless of its opening angle when the water level in the downstream reach is at the same level as the oscillation axis. Under these conditions, the gate tends to close when the downstream level exceeds the axis level and to open when the downstream level drops below the axis level. The gate thus automatically regulates the downstream level to a reference level constituted by the level of the oscillation axis.

Such a gate serves to regulate the level of a canal or basin very reliably and accurately without requiring any energy to be supplied thereto. However, it is designed for reference levels that do not vary since it is not possible in practice to raise or lower the oscillation axis. In some circumstances, it is desirable to be able to vary the reference level.

Various dispositions have been proposed in other situations for varying the reference level, and these are described in U.S. Pat. No. 4,027,486 and European patent application number 0 083 800.

These dispositions include, in particular, means for varying a volume of water contained in a float carried by the upstream face of the plate in order to regulate the upstream level. It would not be economically feasible to implement these dispositions in the above-described constant downstream level gate since the float of such a gate is large and would require very large volumes of water to be inserted or removed. As described in French Pat. No. 2 071 299, the inside volume of the float is used as a bin for ballast and insufficient volume is available for water transfers.

In addition, these dispositions do not allow the substantially neutral nature of the balance of the oscillating assembly to be conserved.

The object of the present invention is to provide a sluice gate for automatically regulating a level which is simple to implement and for which the reference level may be adjusted either manually by easy local action or else remotely by transmitting a low power signal, in particular by means of a telephone line or a radio link, while nevertheless retaining the advantages of an oscillating assembly in which balance is substantially neutral.

SUMMARY OF THE INVENTION

The present invention provides a gate which, when applied to regulating a downstream level, comprises the essential items in common as mentioned above and wherein the substantially neutral character of the balance of the oscillating assembly is conserved even when the reference level needs to be varied, by virtue of the fact that a portion of said balancing masses is transferable and constitutes an adjustment mass, with two adjustment receivers being carried by the said frame at a longitudinal distance apart from each other for the purpose of receiving said adjustment mass.

Preferably, one of said two adjustment receivers is disposed as far away as possible from said oscillation axis. It is also advantageous for the other one of said adjustment positions to be disposed substantially vertically over said oscillation axis when the gate is in its closed position.

BRIEF DESCRIPTION OF THE DRAWINGS

Implementations of the invention are described below by way of non-limiting example and with reference to the accompanying drawings. When different figures show various items of the same description performing the same functions, then they are designated in the figures by the same reference figures. It should be understood that the items mentioned may be replaced by others which perform the same technical functions. In the drawings:

FIGS. 5, 7, and 9 are longitudinal vertical sections through a second, a third, and a fourth gate of the invention, while

DETAILED DESCRIPTION

Figure 1:
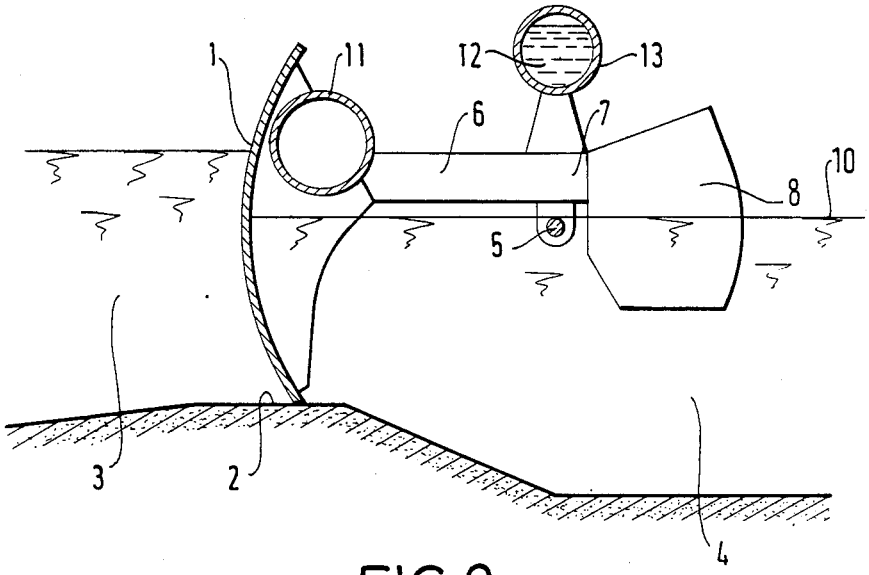
FIGS. 1 to 4 are section views on a longitudinal vertical plane showing a first sluice gate of the invention.

All of these gates are intended to regulate a downstream level and all of them include the above-mentioned dispositions of the invention.

In the figures, the channel is referenced 2, said upstream and downstream reaches are referenced 3 and 4, said oscillation axis is referenced 5, said upstream and downstream branches are 6 and 7, said plate is 1, said float is 8, two position-defining receivers are referenced 11 and 13, and said extreme levels are a minimum level 9 and a maximum level 10 which constitute two limits on a range over which the reference level may vary.

At least some of these sluice gates also include various additional dispositions which are initially described in general terms and numbered in order to facilitate subsequent description of the various different sluice gates.

(1) The two position-defining receivers comprise a compensation receiver 11 disposed at a longitudinal distance from said axis 5 and a correction receiver 13 situated substantially vertically above said axis when the gate is in its closed position. The adjustment mass 12 is such that the gravitational couple which it applies to said oscillating assembly when it is in said compensation receiver compensates for the variation to which said float couple is subjected in said closed position as the downstream level passes from one of said extreme levels to the other. The distance of said correction receiver from said axis 5 is such that transferring the adjustment mass between said two receivers changes said gravitational couple compensating the change in said float couple present in the open position as the downstream level changes from one of said extreme levels to the other.

(2) Said adjustment mass is transferable by fractions and more particularly it is preferably constituted by a ballast fluid 12, with said two receivers being a compensation tank 11 and a correction tank 13, and said fluid being advantageously a liquid such as water.

(3) The gate includes a sensor for sensing the level of said ballast fluid in at least one of said two tanks.

(4) The gate includes remote control means for said transfer means for transferring said ballast fluid.

(5) Said compensation tank is situated on said upstream branch 6 of the frame immediately downstream from said plate 1.

(6) Said compensation tank is constituted by the inside of said float.

(7) Said correction tank is subdivided into a plurality of compartments, with one of the compartments 16 containing a portion of said ballast fluid and with the other compartments 17 and 18 being intended to receive permanent ballast material 19.

(8) Said transfer means include at least one hand pump 21 connected via a pipe 22 to said compensation tank and via a pipe 23 to said correction tank.

(9) Said transfer means include at least one electrically driven pump 24 connected by a pipe 25 to said compensation tank and by a pipe 26 to said correction tank.

(10) The sluice gate comprises:

said float delimited by two vertical side walls 27 and 28 extending sufficiently far downwards to be partially immersed throughout the design range of water level variation, said float also being fitted with a top access hatch 29 enabling ballast material 30 to be inserted in said float; and a tank 31 rigidly connected to the walls of said downstream reach and having four walls 32, 33, 34, and 35 and a bottom 36 surrounding said float on all sides apart from its top, but allowing said float to move about said oscillation axis, said tank communicating with said downstream reach via an orifice 37 in such a manner that the water level inside the tank corresponds to the water level in the downstream reach while avoiding reproducing high frequency variations in said level.

(11) Said channel is constituted by a rectangular orifice through the base of a wall 40 delimiting said upstream reach.

Although either of alternate dispositions number 5 and number 6 may be preferred, depending on circumstances, experience shows that the mass of balance fluid required is minimized when the compensation tank is placed immediately downstream from the plate.

FIGS. 1 to 4 are views of a first gate implementing dispositions numbers 1 and 5, and shown in section on a vertical plane including the axis of the canal. This gate comprises a plate 1 carried at the end of the upstream branch or arm 6 of an oscillating frame which oscillates about an oscillation axis 5, a float 8 carried at the end of the downstream branch or arm 7 of the frame, a compensation tank 11 situated on the upstream branch of the frame immediately downstream from the plate, and a correction tank 13 fixed on the frame vertically above the oscillation axis when the gate is closed.

Figure 2:
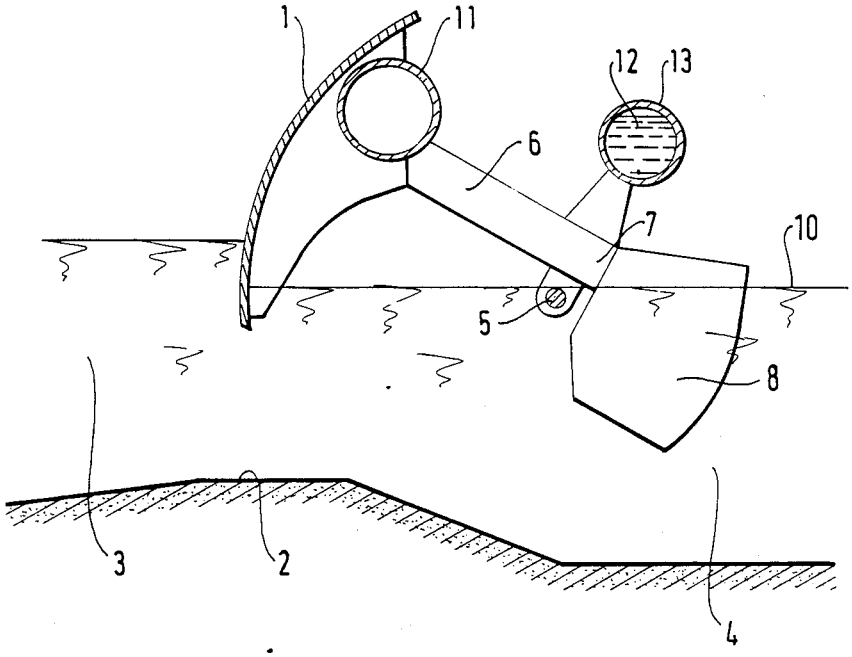
Figure 3:
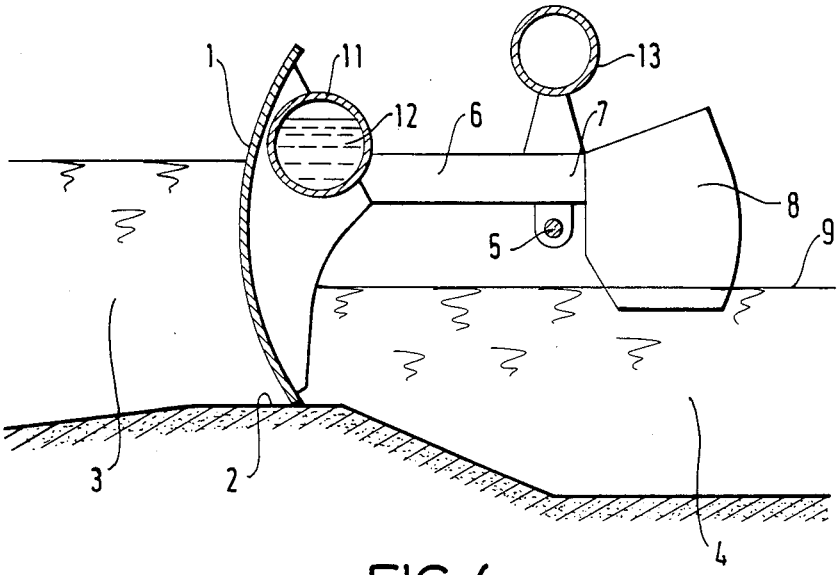
Figure 4:
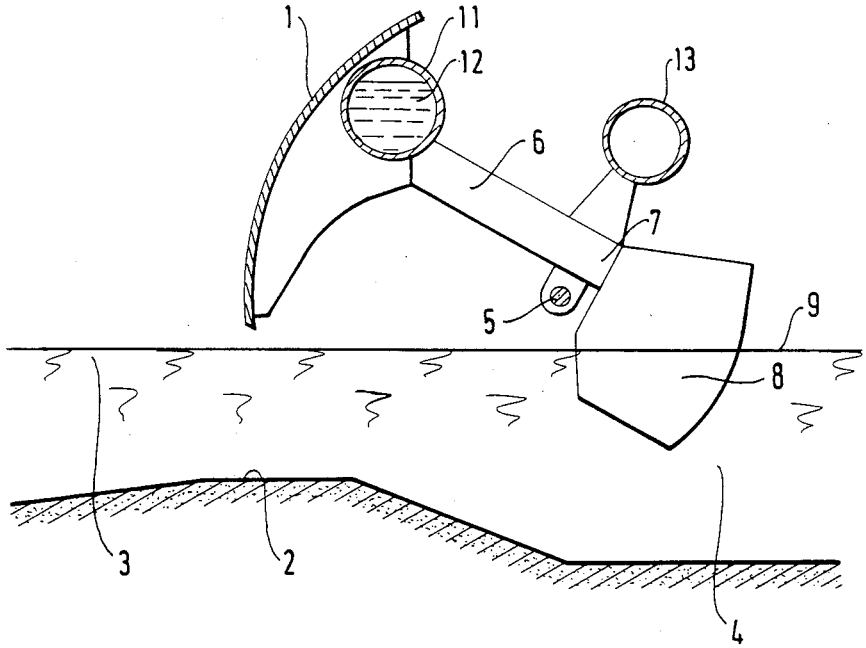

In FIGS. 1 and 3, the gate is shown in its closed position. In FIGS. 2 and 4, it is shown in its open position. In FIGS. 1 and 2, the downstream level is equal to the maximum reference level, whereas in FIGS. 3 and 4, the downstream level is equal to the minimum reference level.

In FIGS. 1 and 2 the mass of ballast fluid is contained in the correction tank which makes it possible, if said mass and the positions of the tanks are in accordance with disposition number 1, to obtain balance in the closed position (FIG. 1), and in the open position (FIG. 2), and consequently to obtain approximate balance in any intermediate position so long as the level of the water in the downstream reach is equal to the maximum reference level 10.

In FIGS. 3 and 4, the mass of ballast fluid is shown as being in the compensation tank, thereby enabling balance to be obtained in all positions of the gate when the water level is equal to the minimum reference level 9.

Figure 5:
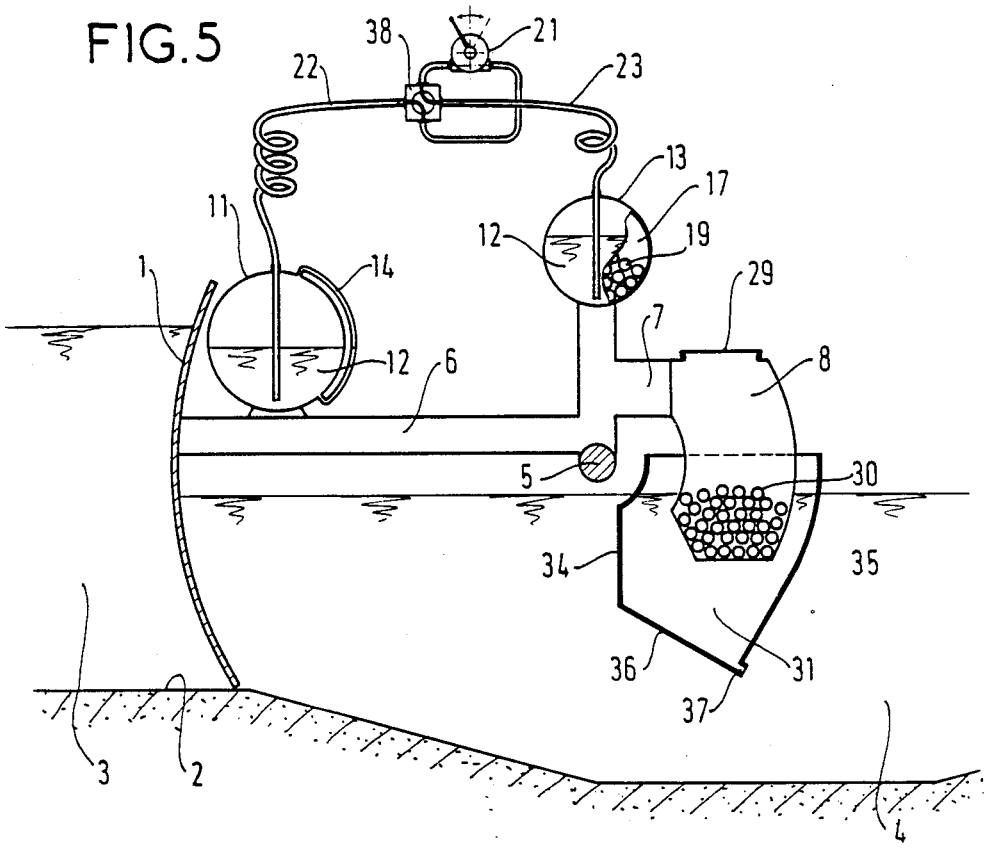
Figure 6:
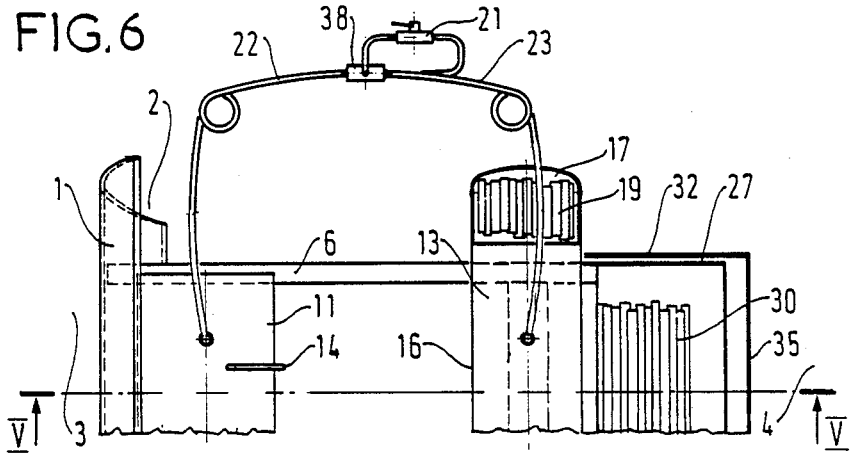
FIGS. 6, 8, and 10 are fragmentary plan views of respective ones of said second, third and fourth gates.

FIG. 5 is a view through a second gate implementing dispositions numbers 1, 2, 3, 5, 7, 8, and 10, and shown in vertical longitudinal section on a plane V-V of FIG. 6.

FIG. 6 is a fragmentary plan view of the gate.

Figure 7:
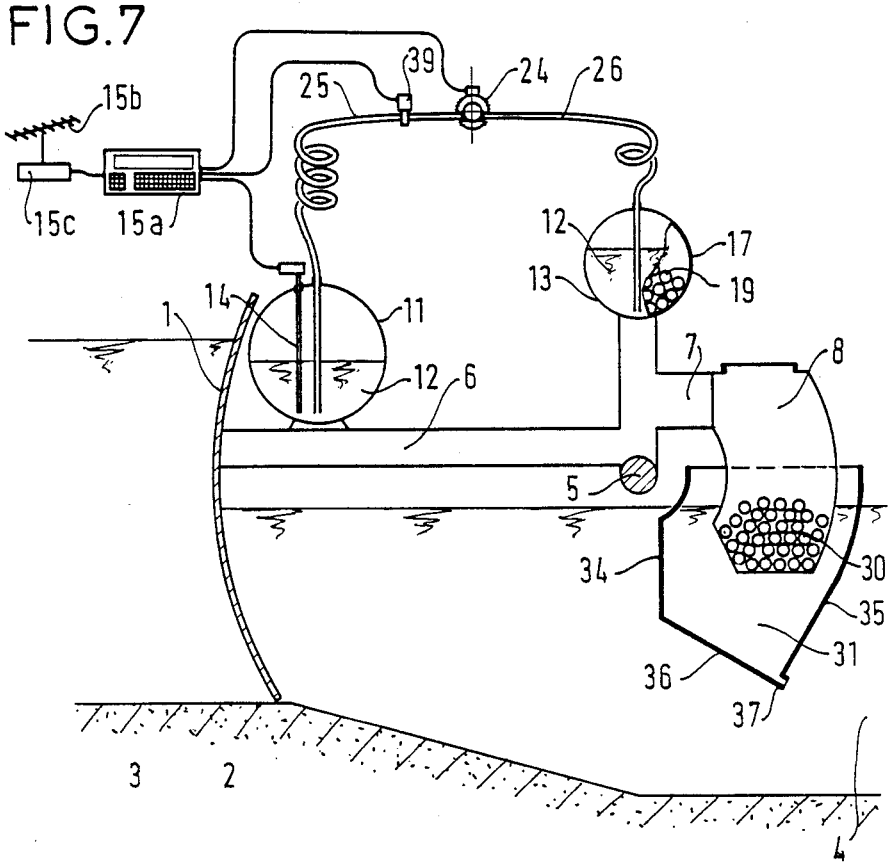
Figure 8:
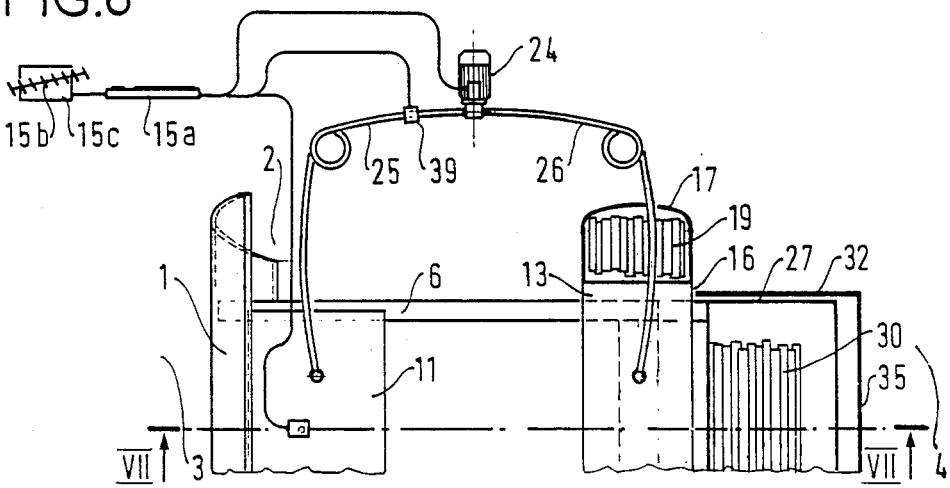

FIG. 7 is a view through a third gate implementing disposition numbers 1, 2, 3, 4, 5, 7, 9, and 10 shown in section on a longitudinal vertical plane VII-VII of FIG. 8.

FIG. 8 is a fragmentary plan view of the third gate.

The characteristics common to the gate shown in FIGS. 5 to 8 are described below:

Both of these gates are disposed on a canal and each of them separates an upstream reach 3 from a downstream reach 4 by means of a metal plate 1 which moves in a concrete channel 2.

The plate is carried at the end of the upstream branch 6 of a frame oscillating about a transverse horizontal axis 5. The upstream branch also carries, immediately downstream from the plate, a cylindrically shaped compensation tank 11.

The downstream branch 7 has a float 8 in the form of a sector of a torus at its end. This float moves inside a tank 31 which communicates with the downstream reach via an orifice 37. The float has an access hatch 29 enabling solid ballast to be inserted therein.

In addition, the frame carries a correction tank 13 at a point which is situated vertically above the axis when the gate is in its closed position. The tank is divided into three compartments: the first compartment 16 being intended to receive the ballast fluid, and the other two compartments 17 and 18 being intended to receive solid ballast.

These two gates are adjusted as follows:

the water level of the downstream reach is adjusted to its maximum reference level, and all of the ballast fluid mass is inserted in the fluid compartment 16 of the correction tank;

the gate may then be balanced in conventional manner, as described, for example, in French Pat. No. 2 071 299, initially by balancing the gate in its closed position by inserting ballast into the float, and subsequently by balancing the gate in its open position by inserting ballast into a bin disposed vertically above the oscillation axis when the gate is in its closed position; in the present case this bin is constituted by the two compartments 17 and 18 of the correction tank;

if the total mass of the ballast fluid and the distance from the center of the correction tank to the oscillation axis are designed in accordance with disposition number 1, then the gate is balanced in its open position and in its closed position when the water level in the downstream reach is at its minimum reference level providing the total mass of ballast fluid has been transferred from the correction tank to the compensation tank; and each level of water in the downstream reach lying within the range over which the reference level is adjustable is associated with a corresponding gate-balancing distribution of the ballast fluid between the two tanks, with the gate being balanced in its open position, in its closed position and in all intermediate positions.

Thus, each distribution of ballast fluid between the two tanks corresponds to a different reference level for the downstream reach, with the gate operating in an entirely self-contained and automatic manner for maintaining said reference level in accordance with the known principles recalled at the beginning of the present description.

The advantage of the present invention is to make it possible to adjust the reference level for regulation purposes easily by transferring ballast fluid from one tank to another, with regulation itself always taking place by virtue of the known principles of sluice gates having a float and a counterweight, and with the efficiency that results from the substantially neutral character of the balance of the oscillating assembly.

In the gate shown in FIGS. 5 and 6, a hand pump 21 is connected via a pipe 22 to the compensation tank and via a pipe 23 to the correction tank. A four-way cock 38 serves to reverse the direction of transfer. A level sensor 14 is constituted by a transparent tube interconnecting the top and bottom portions of the tank.

In the gate shown in FIGS. 7 and 8, a reversible electrically driven pump 24 is connected by a pipe 25 to the compensation tank and by a pipe 26 to the correction tank. An electrically controlled valve 39 serves to disconnect communication between the tanks once transfer has been terminated. A level sensor 14 provides an electrical signal proportional to the level of ballast fluid in the compensation tank. The ballast fluid is transferred under the control of a programmable controller **15*a* which controls the electrically driven pumps and the electrically controlled valves so as to obtain the desired fluid level in the compensation tank. The controller acts as a function of reference-changing instructions that it receives by radio via an antenna 15*b* and a modem 15*c***.

Figure 9:
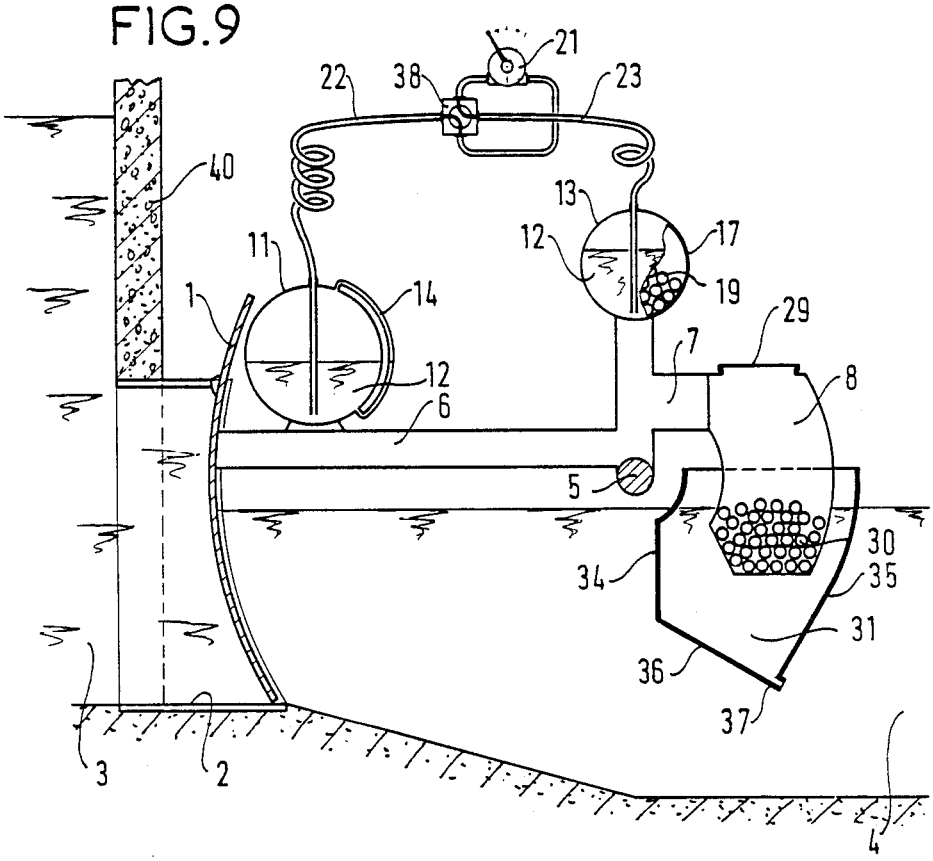
Figure 10:
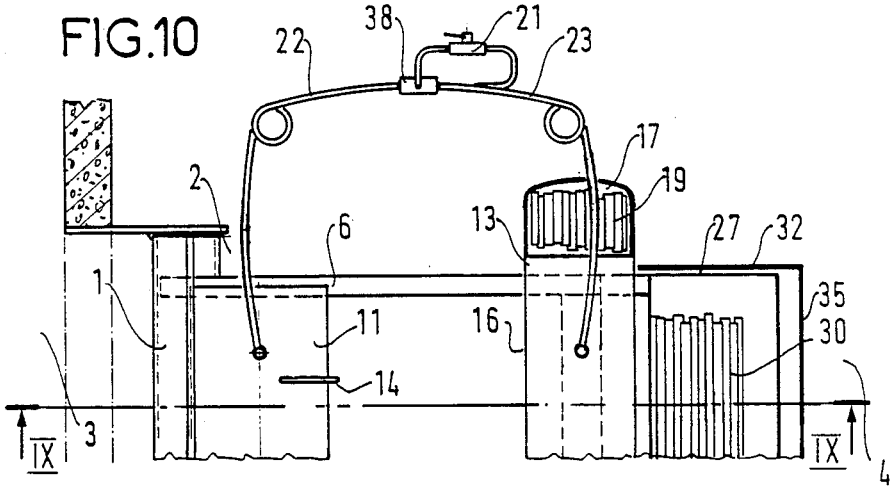

Finally, FIG. 9 is a view of a fourth gate implementing dispositions numbers 1, 2, 3, 5, 7, 8, and 11 shown in section on a longitudinal vertical plane IX—IX of FIG. 10.

FIG. 10 is a fragmentary plan view of the fourth gate.

Dispositions analogous to those described above may advantageously be used in a gate for regulating an upstream level. Also, the reference level may be adjusted by transferring a solid mass between two positions defined relative to the moving assembly with the above-described receivers then constituting two such positions. That is why the present invention relates in more general terms to an automatic level regulating gate comprising:

means for enabling said gate to oscillate about a transverse oscillation axis;

a plate disposed upstream from said oscillation axis in order to close to a greater or lesser extent a channel between a regulated level reach and another reach, said plate being cylindrical in shape about said axis;

a float dipping to a greater or lesser extent into said regulated level reach in order to raise or lower said plate as a function of variations in the level of said reach; and adjustable balancing masses for conferring substantially neutral balance on said gate when the level of said regulated level reach is at a reference value;

said gate further including an adjustment support system for maintaining, on command, an adjustment mass in one or other of at least two adjustment positions situated at a longitudinal distance apart from each other so as to vary said reference level while retaining the substantially neutral character of said balance.

I claim:

1. A sluice gate for automatically regulating a level of liquid flowing within a channel, the gate comprising:

means for enabling said gate to oscillate about a transverse oscillation axis;

a plate disposed upstream from said oscillation axis in order to close to a greater or lesser extent said channel between a regulated level reach and another reach, said plate being cylindrical in shape about said axis;

a float operatively connected to said plate and dipping to a greater or lesser extent into said regulated level reach in order to raise or lower said plate as a function of variations in the level of said reach; and adjustable balancing masses for conferring substantially neutral balance on said gate when the level of said regulated level reach is at a reference value;

wherein said gate further includes an adjustment support system for maintaining, on command, an adjustment mass in one or other of at least two adjustment positions situated at a longitudinal distance apart from each other so as to vary said reference level while retaining the substantially neutral character of said balance.

2. A gate according to claim 1, further including transfer means for transferring said adjustment mass between said two positions.

3. A gate according to claim 2, including remote control means for controlling said transfer means.

4. A gate according to claim 1, wherein said adjustment mass is transferable in fractions.

5. A gate according to claim 1, wherein said adjustment mass is a ballast fluid, said adjustment support system comprising a compensation tank and a correction tank for receiving said fluid.

6. A gate according to claim 1 wherein:

said channel extends between an upstream reach and a downstream reach having respective upstream and downstream liquid levels and following one another in a longitudinal horizontal direction;

said oscillation axis is disposed transversely, horizontally and downstream from said channel; and said adjustment support system includes an oscillating assembly moving about said axis between angular positions lying between a closed position and open position, each of which positions is defined by an opening angle relative to said closed position, said assembly comprising:

a frame having an upstream branch and a downstream branch disposed upstream and downstream of said axis; and wherein said plate is carried by said upstream branch in said channel in order to close said channel to a greater or lesser extent, thereby controlling the flow rate of said liquid through the gate, said channel being closed in said closed position and being open in said open position, said plate being cylindrical in shape about said axis so that the hydrostatic thrust it receives from the upstream reach does not apply at interfering couple on said oscillating assembly;

said float is carried by said downstream branch so as to have a variable portion of its height dipping into the liquid of said downstream reach in order to apply a float couple to said oscillating assembly which is directed towards said closed position and which increases firstly with increasing downstream liquid level and secondly with increasing opening angle, said float being substantially in the form of a body of revolution about said axis and occupying a limited angular sector such that said float couple varies substantially linearly with said angle;

said balancing masses are situated at least in part at a longitudinal distance from said axis;

said adjustment mass is constituted by a transferrable portion of said balancing masses;

two adjustment receivers constitute said adjustment support system and are carried by said frame at a longitudinal distance apart from each other in order to receive said adjustment mass, said two receivers comprising a compensation receiver situated at a longitudinal distance from said axis and a correction receiver situated substantially vertically over said axis when the gate is in said closed position, said adjustment mass being such that an adjustment mass gravity couple is applied to said oscillating assembly when said compensation receiver compensates for the variation to which said float couple is subjected in said closed position when the downstream level changes from one to the other of two extreme reference levels, and the distance of said correction receiver from said axis being such that the transfer of said adjustment mass between said two receivers establishes a change in said gravity couple compensating the variation in said float couple present in the open position when said downstream level changes from one of said extreme reference levels to the other.

7. A gate according to claim 6, wherein said compensation receiver is situated on said upstream branch of the frame immediately downstream from said plate.

8. A gate according to claim 6, wherein said correction receiver is a correction tank divided into a plurality of compartments, one of said compartments functioning to receive a ballast fluid constituting said adjustment mass and the other compartment functioning to receive permanent balancing masses.

* * * * *